US006065961A

United States Patent [19]

Shaffer et al.

[11] Patent Number: 6,065,961

[45] Date of Patent: May 23, 2000

[54] LOW $NO_X$ BURNER

[76] Inventors: Yul E. Shaffer, 625 E. 4th, Bristow, Okla. 74010; Ronald M. Engler, 6824 E. 95th St. S., Tulsa, Okla. 74133

[21] Appl. No.: 09/249,867

[22] Filed: Feb. 16, 1999

[51] Int. Cl.[7] ..... F23D 14/12

[52] U.S. Cl. ..... 431/328; 431/173; 431/278; 431/349; 431/354

[58] Field of Search ..... 431/328, 8, 10, 431/173, 278, 337, 349, 326, 353, 354; 60/39.06, 737, 746

[56] References Cited

U.S. PATENT DOCUMENTS

| | | | |
|---|---|---|---|
| 3,718,426 | 2/1973 | Harris | 431/328 |
| 3,825,400 | 7/1974 | Popov | 431/328 |
| 3,923,447 | 12/1975 | Desty et al. | 431/328 |
| 3,963,443 | 6/1976 | Bond et al. | 23/262 |
| 3,975,141 | 8/1976 | Sweet | 431/352 |
| 4,140,447 | 2/1979 | Bosnakovic | 425/43 |
| 4,378,206 | 3/1983 | Kullendorff et al. | 431/328 |
| 4,484,885 | 11/1984 | Machii et al. | 431/354 |
| 4,952,139 | 8/1990 | Goldenberg | 431/353 |
| 5,145,361 | 9/1992 | Kurzinski | 432/19 |
| 5,328,355 | 7/1994 | Kobayashi et al. | 431/10 |
| 5,447,427 | 9/1995 | Suzuki | 431/7 |
| 5,449,439 | 9/1995 | Heald | 431/354 |
| 5,489,203 | 2/1996 | Dobbeling et al. | 431/173 |

FOREIGN PATENT DOCUMENTS 61-268912 11/1996 Japan .

OTHER PUBLICATIONS

Maxon Corporation, Industrial Combustion Equipment and Valves, pp. 3211–3220.

*Primary Examiner*—Ira S. Lazarus
*Assistant Examiner*—Josiah C. Cocks
*Attorney, Agent, or Firm*—Head, Johnson and Kachigian

[57] ABSTRACT

A gas mixer is provided which is especially suitable for a burner which includes a plurality of parallel supply tubes for a first gaseous reactant passing through a sealed distribution manifold through which a second reactant may be educed into each tube through an annular arrangement of orifices and admixed with the first reactant until said admixture reaches the outlet of each tube where, through ignition, an individual flamelet is formed, the multiplicity of which form a collective flame with an homogeneous ratio of reactants through the entire cross section of the flame.

18 Claims, 3 Drawing Sheets

ALONG AA

LOW $NO_X$ BURNER

CROSS-REFERENCE TO RELATED APPLICATION

Not applicable.

BACKGROUND OF THE INVENTION

1. Field of the Invention

The present invention relates to burner apparatus and method for combusting air and fuel characterized in that the fuel is thoroughly mixed with combustion air in a manner so that resultant combustion is complete and oxides of nitrogen ($NO_x$) in the exhaust gas are substantially reduced. "Fuel" as used herein means gas and/or liquid fuel.

2. Description of the Related Art

Combustion is a chemical process in which an oxidant is rapidly reacted with a fuel to release chemically stored energy as thermal energy. This thermal energy is usually in the form of high temperature gases. Most commonly, the oxidant for combustion is oxygen in the air. Hydrocarbon gases principally consist of hydrogen and carbon compounds and the complete combustion of these gases produces mainly carbon dioxide and water. When the combustion of air and fuel is produced at a high temperature, oxides of nitrogen (NOx) are produced due to dissociation of the molecular Nitrogen. Oxides of nitrogen gases are considered to be an environmental hazard.

In all burners, there will be regions of reactant mixture where either combustion will be incomplete or the formation of $NO_x$ will occur. Ideally, it is desirable to provide a completely homogeneous mixture with the ratio of the reactants suitably balanced to effect the best achievable combustion byproducts for a given application.

Conventional methods of mixing the fuel and air generally provide a mixture gradient through the cross section of the flamefront at the point of ignition that causes a corresponding thermal gradient through the flame. This causes both the production of $NO_x$ within the higher temperature (Stoichmetric) sections of the flame; and Carbon Monoxide, Aldehydes, Ketones and Unburned Combustibles within the colder sections of the flame (i.e., sections comprising excessive fuel and sections comprising excessive air).

Where conventional methods of producing exceptional results with respect to low $NO_x$s have succeeded, they have generally paid for said results with any combination of the following: (1) the need for relatively high combustion air blower pressure necessitating an increased consumption of electricity; (2) relatively elevated fuel pressure requirements; (3) the recirculation of cooled flue gases to absorb enough of the heat from the initial combustion zone to prevent $NO_x$ formation; and/or (4) the inability to extend the performance through a wide range of turndown.

The present invention relates to an apparatus and method for hydrocarbon and other combustibles fuel burners to provide means for controlling the mixing of the reactants and thus, controlling the nature of the combustion kinetics. In another aspect, this invention relates to a novel method and means for limiting the production of thermally produced Nitric Oxides (NO and $NO_2$ or "$NO_x$"), and other unburned combustibles, in general combustion systems and heating applications.

Thus, to provide for the complete combustion of the fuel in a more economical manner while reducing $NO_x$, CO and all other undesirable organic compounds, a better method and apparatus of mixing the reactants is desirable.

SUMMARY OF THE INVENTION

The method and apparatus of the present invention provides a mixture of reactants which is homogeneous across a cross section within the combustion zone, perpendicular to a flame.

The method and apparatus of mixing the reactants provided to the combustion zone is by positioning a plurality of oxidant supply tubes through a fuel distribution manifold, and educing the fuel into the tubes through orifices provided in the portion of the tubes located within the fuel distribution manifold. The fuel is initially provided in an annular region between a casing and the tubes. For the present invention, the homogeneity of the mixture is unchanged regardless of the number of tubes.

Ignition is initiated at the outlet of the tubes. Each tube produces an individual flamelet. The overall number of tube/flamelets can be varied to achieve the required duty for a specific application. The collective flamelets produce a flamefront away from the outlet ends of the tubes.

Thus, one object of the present invention is to provide an oxidant/fuel mixture that is homogeneous across a cross section of the combustion chamber normal to the flame.

Another object of the invention is to provide a fuel burner in which the undesirable emissions have been minimized.

Another object of the invention is to provide a fuel burner which utilizes a relatively low combustion air blower pressure.

BRIEF DESCRIPTION OF THE DRAWINGS

In addition to providing the advantages and fulfilling the objects described above, other advantages and features of the invention will be apparent from the following description in conjunction with the appended drawings in which.

DETAILED DESCRIPTION OF THE PREFERRED EMBODIMENTS

Figure 1:
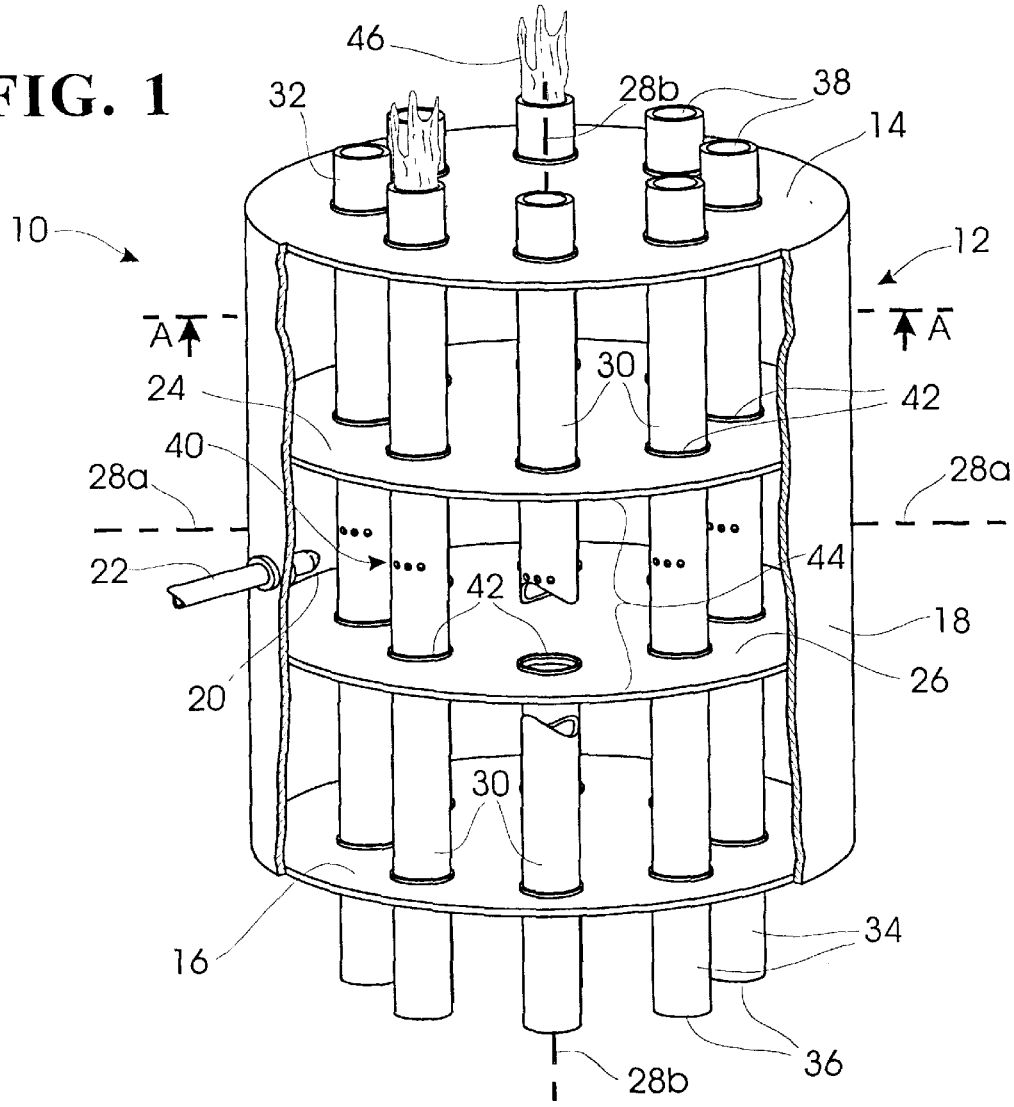
FIG. 1 is a cross-sectional view of a burner of the present invention illustrating a single fuel cell.

FIG. 1 illustrates gas burner 10 having casing 12. Casing 12 has a top 14, a bottom 16 and a sidewall 18. The use of top 14 and bottom 16 is not meant to limit the present invention. Top 14 and bottom 16 are meant to illustrate a single embodiment of the present invention. Further, casing 12 has a fuel inlet port 20 to receive fuel supply line 22. Casing 12 is a cylinder having a horizontal axis **28*a* and a vertical axis 28*b*. It is understood that the terms horizontal and vertical as used herein are for reference and do not limit the application of the present invention. Further, it is understood that the cylindrical nature of casing 12 is for illustration and does not limit the shape of casing 12. A first plate 24 and a second plate 26 are positioned within casing 12 substantially parallel with said horizontal axis, with said first plate 24 being positioned above fuel inlet port 20 and said second plate 26 being positioned below fuel inlet port 20 creating fuel cell 44**.

Figure 3:
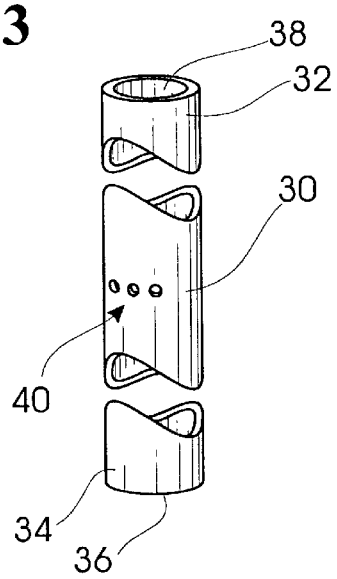
FIG. 3 illustrates a tube for a burner of the present invention.

Both first plate 24 and second plate 26 have openings 42 in which to receive a plurality of tubes 30. Each tube 30 is positioned substantially vertical within casing 12. As shown in FIG. 3, each tube 30 has a top 32, a bottom 34, an inlet 36, an outlet 38 and a plurality of orifices 40. Each tube 30 is secured to its counterpart opening 42 by a securing means. Orifices 40 are positioned in the portions of the tubes between the second plate 26 and the first plate 24.

In operation, pressurized air is provided to tube inlets 36 by a compressor (not shown). Air flows upward from tube inlet 36 to tube outlet 38. Fuel is provided to cell 44 through the fuel inlet line 22. When the flowing air in the tubes 30 passes the tube orifices 40, the air educes the fuel into the tubes 30. The fuel and air mix in the tubes to form a fuel/air mixture. The fuel/air mixture flows through the tube outlet 38 and is ignited by flame 46.

Figure 2:
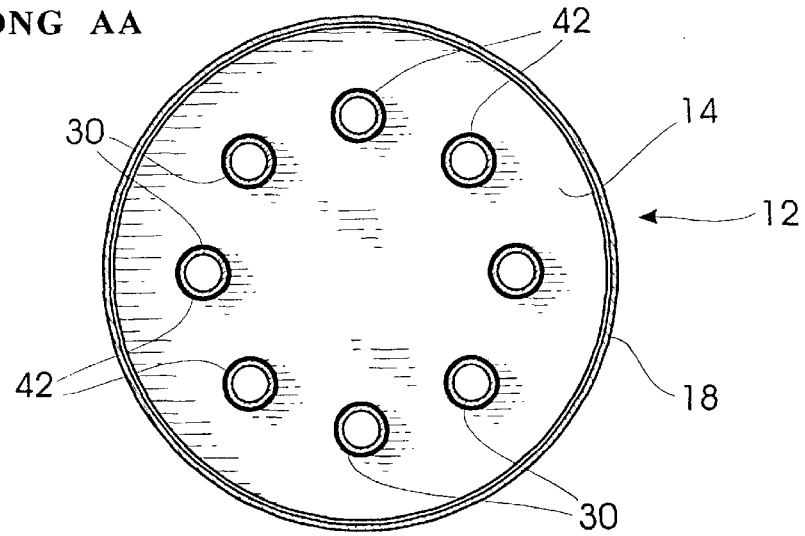
FIG. 2 shows a top view of section AA, as indicated in FIG. 1, for a burner of the present invention.

FIG. 2 illustrates a series of tubes 30 in a circular pattern. This pattern is meant to be illustrative and not meant to limit the present invention. It is contemplated that the present invention could incorporate multiple tube patterns.

Figure 4:
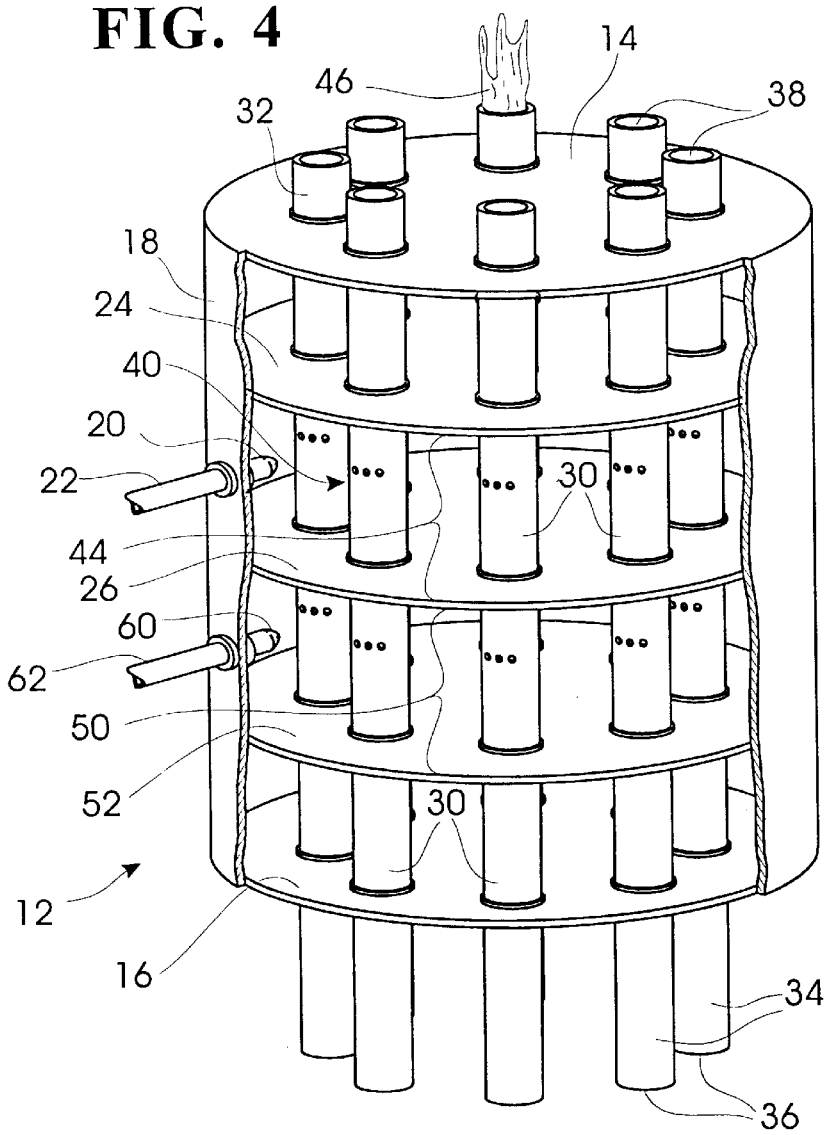
FIG. 4 is a cross-sectional view of a burner of the present invention illustrating multiple fuel cells.

FIG. 4 illustrates the preferred embodiment having a second fuel cell 50. A third plate 52 is positioned within casing 12 substantially parallel with said horizontal axis, with said third plate 52 being positioned below said second plate 26 and above bottom 16 creating second fuel cell 50. A second fuel inlet port 60 to receive second fuel supply line 62 is located within sidewall 18 between said second plate 26 and said third plate 52.

In operation, pressurized air is provided to tube inlets 36 by a compressor (not shown). Air flows upward from tube inlet 36 to tube outlet 38. A first fuel is provided to cell 44 through the fuel inlet line 22 and a second fuel is provided to second cell 50 through second fuel inlet line 62 either simultaneously or at different times. When the flowing air in the tubes 30 passes the tube orifices 40, the air educes the fuel into the tubes 30. The fuel and air mix in the tubes to form a fuel/air mixture. The fuel/air mixture flows through the tube outlet 38 and is ignited by flame 46.

Figure 5:
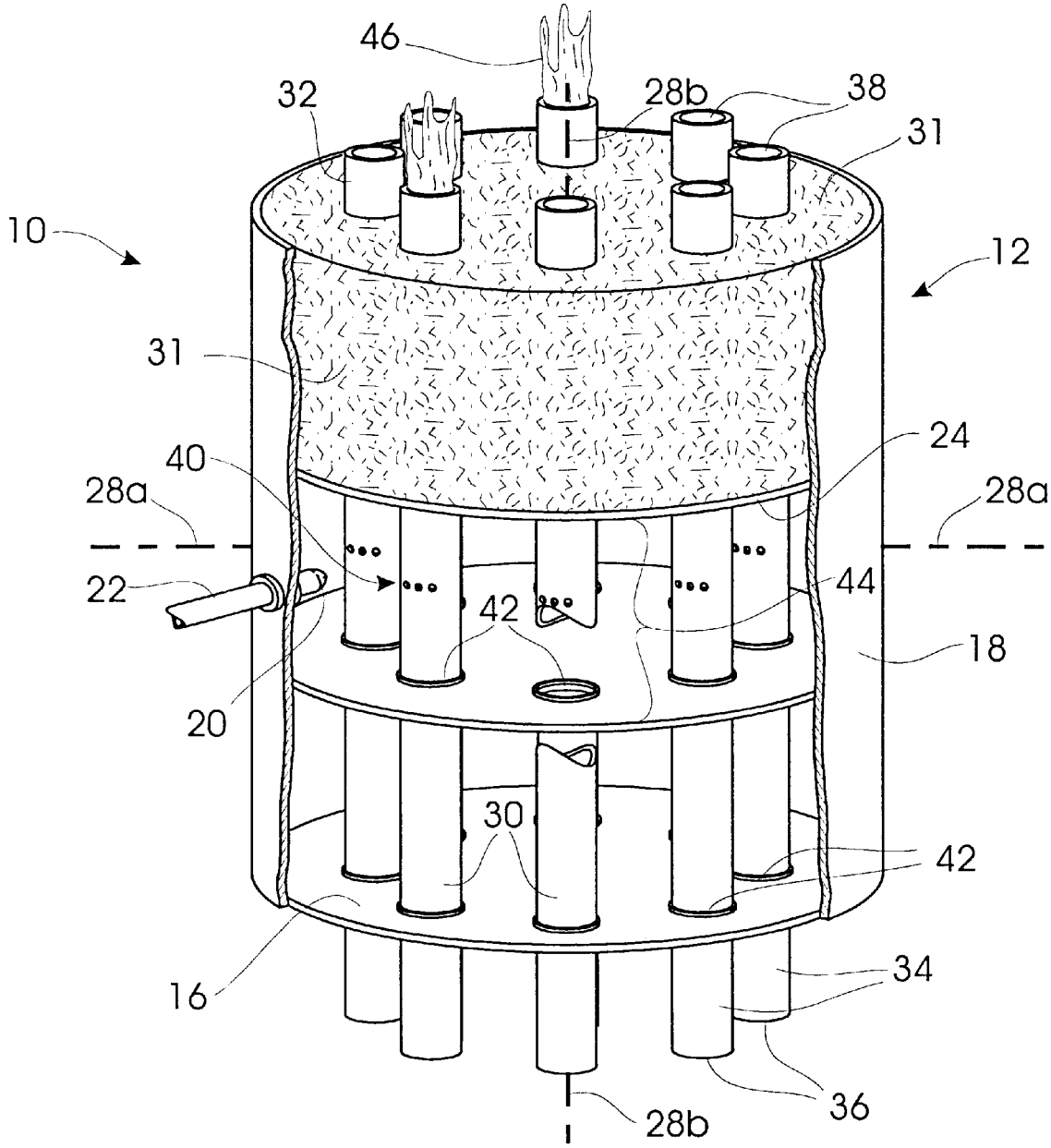
FIG. 5 is a cross-sectional view of an alternative embodiment of the present invention.

FIG. 5 illustrates an additional embodiment of the present invention whereas burner 10 having a layer of insulation 31 resting on first plate 24 and encasing tubes. Insulation 31 prevents radiant and convective heat from coming in contact with cell 44. This prevents thermal degradation from occurring.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A low NOx burner for combusting fuel and air comprising:

a casing having a top edge, a bottom edge and a sidewall defining an interior;

first means for receiving first fuel located within the sidewall;

a first plate of the same dimensions as the cross-section of the casing having a plurality of spaced apart first openings and being secured to said interior between said top edge and said means for receiving first fuel;

a second plate of the same dimensions as the cross-section of the casing having a plurality of spaced apart second openings and being secured to said interior between said means for receiving first fuel and said bottom edge, wherein the space between the first plate and the second plate creates a first cell;

a plurality of tubes with each tube having an inlet end to receive air, a body having a plurality of orifices to receive said first fuel and an outlet with each tube being received within a first opening and a second opening wherein the orifices of each tube are located within said first cell.

2. The burner of claim 1 wherein said first means for receiving first fuel is a gas port.

3. The burner of claim 1 wherein said first fuel is liquid fuel.

4. The burner of claim 1 wherein said first fuel is gas fuel.

5. The burner of claim 1 wherein the number of first openings is equal to the number of second openings.

6. The burner of claim 1 wherein the means for receiving fuel receives said fuel from a fuel supply line.

7. The burner of claim 1 wherein said air is turbulent air.

8. The burner of claim 1, wherein said casing further comprising a top plate and a bottom plate.

9. The burner of claim 1, wherein said plurality or tubes are arranged to form a pattern.

10. The burner of claim 1, wherein said pattern is circular.

11. The burner of claim 1, further comprising a layer of insulation above said first plate and encasing said plurality of tubes.

12. A low NOx burner for combusting fuel and air comprising:

a casing having a top edge, a bottom edge and a sidewall defining an interior;

first means for receiving first fuel located within the sidewall;

a first plate of the same dimensions as the cross-section of the casing being secured to said interior between said top edge and said means for receiving first fuel, said first plate having a plurality of spaced apart first openings;

a second plate of the same dimensions as the cross-section of the casing being secured to said interior between edge said means for receiving first fuel and said bottom, wherein the space between the first plate and the second plate creates a first cell, said second plate having a plurality of spaced apart second openings wherein the number of second openings is equal to the number of first openings;

a plurality of tubes with each tube having an inlet end to receive turbulent air, a body having a plurality of orifices to receive said first fuel and an outlet with each tube being received within a first opening and a second opening wherein the orifices of each tube are located within said first cell, wherein the number of tubes is equal to the number of first openings.

13. The burner of claim 12 wherein said first means for receiving fuel is a gas port.

14. The burner of claim 12 wherein said first fuel is liquid fuel.

15. The burner of claim 12 wherein said first fuel is gas fuel.

16. The burner of claim 12 wherein the first means for receiving first fuel receives said fuel from a fuel supply line.

17. The burner of claim 12 further comprising:

a third plate of the same dimensions as the cross-section of the casing having a plurality of spaced apart third openings and being secured to said interior between said second plate and said bottom edge, wherein the space between said second plate and said third plate creates a second cell;

a second means for receiving second fuel located within said sidewall between said third plate and said bottom edge;

a plurality of second orifices located on the body of each tube within the second cell.

18. The burner of claim 17 wherein said first fuel is liquid fuel and said second fuel is gas fuel.

* * * * *